US005272607A

United States Patent [19]

Grimm

[11] Patent Number: 5,272,607

[45] Date of Patent: Dec. 21, 1993

[54] LIGHTING FIXTURE

[75] Inventor: Manfred Grimm, Arnsberg, Fed. Rep. of Germany

[73] Assignee: Thorn Licht GmbH, Arnsberg, Fed. Rep. of Germany

[21] Appl. No.: 942,966

[22] Filed: Sep. 10, 1992

[30] Foreign Application Priority Data

Oct. 1, 1991 [DE] Fed. Rep. of Germany ..... 4132678

[51] Int. Cl.[5] ..... F21S 3/00

[52] U.S. Cl. ..... 362/219; 362/247; 362/298

[58] Field of Search ..... 362/298, 219, 247

[56] References Cited

U.S. PATENT DOCUMENTS 2,219,383 10/1940 Dillon ..... 362/219

5,097,401 3/1992 Eppler ..... 362/298

FOREIGN PATENT DOCUMENTS 144803 6/1990 Japan ..... 362/298

245828 8/1947 Switzerland ..... 362/297

*Primary Examiner*—Carroll B. Dority

*Attorney, Agent, or Firm*—Henry M. Feiereisen

[57] ABSTRACT

A lighting fixture suspendable from a ceiling above a working area for illuminating a workplace includes two fixture parts spaced from each other in longitudinal direction and each radiating light generated by at least one fluorescent lamp exclusively toward the top side thereof. Arranged above and at a distance to the first and second fixture parts is a reflector by which a fraction of upwardly radiated incident light rays is downwardly reflected in direction of the workplace.

10 Claims, 3 Drawing Sheets

LIGHTING FIXTURE

BACKGROUND OF THE INVENTION

The present invention refers to a lighting fixture, and in particular to a ceiling fixture which is suspended from a ceiling above a working area for illuminating a workplace and is of a type having two fixture parts spaced from each other in longitudinal direction and including at least one fluorescent lamp.

A lighting fixture of this type is known for example from German patent specification DE-OS 33 01 277 which includes a housing with an outlet opening in a central area thereof. Light rays radiate through the top side and impinge upon the ceiling of the room to thereby create an indirect diffuse illumination of the surroundings. In addition to the central outlet opening, the lighting fixture also includes two outlet openings which are spaced from each other in longitudinal direction of the housing and open toward the bottom side of the fixture. These outlet openings at the bottom of the lighting fixture have guide elements, e.g. in form of a louver, by which direct light is downwardly emitted from the lateral ends of the fixture in opposition to each other so that the working area is illuminated through obliquely incident light from the sides of the lighting fixture.

SUMMARY OF THE INVENTION

It is an object of the present invention to provide an improved lighting fixture by which the working area is illuminated through indirect light in a non-glaring manner, with the illumination of the working area being characterized by improved shading and contrasts at comparably high contrast rendition factor (CRF values).

This object and others which will become apparent hereinafter are attained in accordance with the present invention by providing a lighting fixture with two spaced fixture parts, each of which emitting light exclusively through the top side, and by arranging a reflector above and at a distance to the lighting fixture so that in addition to a fraction of upwardly radiating light being reflected from the room ceiling and creating an indirect diffuse illumination of the surroundings a further fraction of upwardly radiating light is downwardly reflected by the reflector in direction toward the workplace.

Preferably, the reflector is made of glass, with both its lateral ends extending beyond the width of the subjacent lighting fixture so that light reflected from the glass reflector can be directed past both lateral ends of the fixture downwardly upon working areas of e.g. two adjoining workplaces for use by two persons and for illumination of primarily the central working area of the respective workplace e.g. a desk.

According to a further feature of the present invention, the glass reflector may be slightly concave e.g. parabolic or circular arc shaped.

The fraction of light radiating through the glass reflector toward the room ceiling and the fraction of light reflected from the glass reflector may be modified through suitable selection of the utilized glass.

Indirect light upwardly emitted from the first and second outer fixture parts is downwardly reflected by the glass reflector to radiate primarily obliquely from lateral directions upon the workplace or workplaces while the central area of the lighting fixture does not generate any light and serves only for mechanic connection of both fixture parts of the lighting fixture. However, since the glass reflector preferably spans over the entire lighting fixture, light may also be reflected by the glass reflector downwardly through the central area of the fixture to additionally contribute to the illumination of the working area.

The fraction of light reflected from the glass reflector generates sufficient shading and improved contrasts in the working area so that a lighting fixture in accordance with the present invention has high CRF values and yet at the same time illuminates the workplace in a non-glaring manner. Thus, a lighting fixture according to the invention satisfies high standards demanded for workplace illumination for certain types of profession such as designers or commercial artists.

The use of a glass reflector which spans over the housing of all fixture parts creates a lighting fixture which generates relatively bright illumination.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
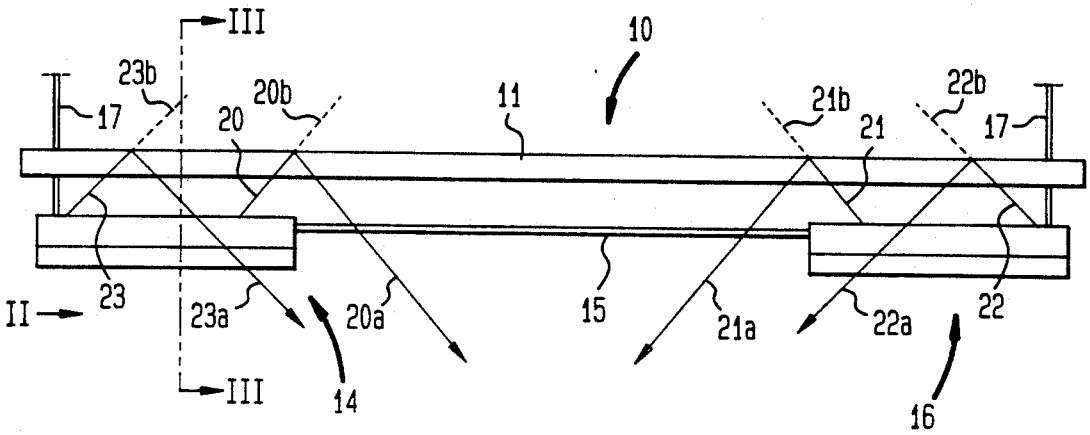
FIG. 1 is a simplified schematic side view of one embodiment of a lighting fixture according to the present invention.
Figure 1:
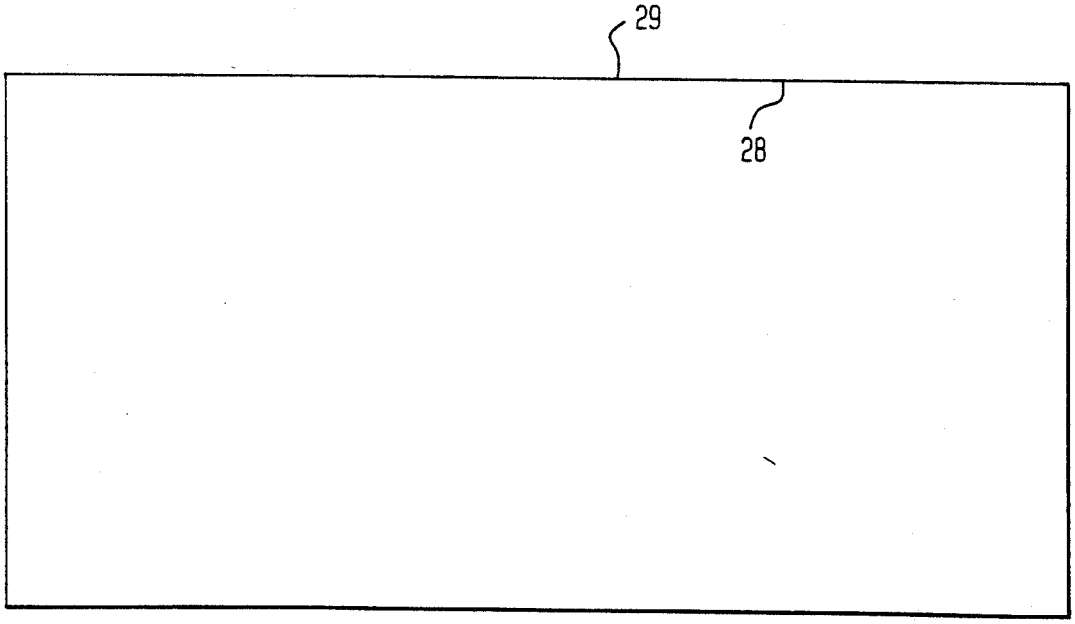

Throughout all the Figures, the same or corresponding elements are always indicated by the same reference numerals.

Referring now to the drawing and in particular to FIG. 1, there is shown a simplified schematic side view of one embodiment of a lighting fixture according to the present invention, generally designated by reference numeral 10. The lighting fixture 10 is of elongated configuration and is essentially a three-part structure, with a left fixture part 14 and a right fixture part 16 which are mechanically connected to each other by a central fixture part 15. Each of the left and right fixture parts 14, 16 includes two fluorescent lamps (see fluorescent lamps 30, 31 in FIG. 3) which extend in longitudinal direction thereof. Persons skilled in the art will understand that the number of fluorescent lamps in the lighting fixtures 14, 16 may vary. No fluorescent lamp is accommodated in the central fixture part 15.

Figure 3:
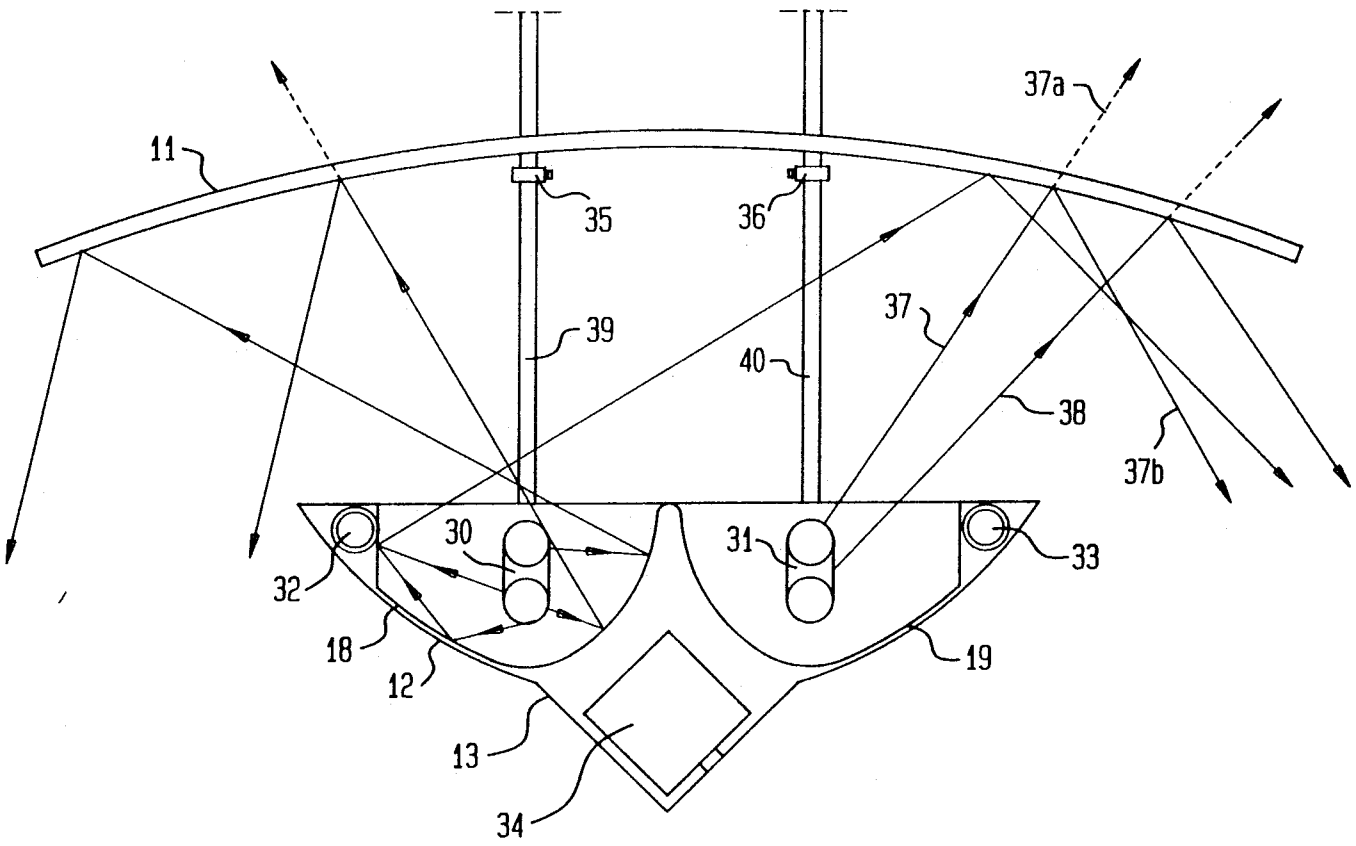
FIG. 3 is an enlarged cross sectional view of the lighting fixture taken along the line III—III in FIG. 1.

The lighting fixture 10 is suspended from a ceiling in longitudinal direction above e.g. a desk 28 by means of rod-like mounts 17 in such a manner that central part 15 extends above the work area 29 to be illuminated. As best seen in FIG. 3, which is an enlarged cross sectional view of the lighting fixture 10 taken along the line III—III in FIG. 1, each of the outer left and right fixture parts 14, 16 has an elongated housing 12 with closed bottom and cup-shaped configuration in the outer sections thereof. The central area of the housing 12 is provided with a triangular shaped protrusion 13 with downwardly facing tip to create additional space for a ballast 34 for operation of the fluorescent lamps 30, 31.

The housing 12 of each fixture part 14, 16 is further provided with two adjacent cup-shaped reflectors 18, 19 which surround the fluorescent lamps 30, 31.

The central part 15 by which the left and right fixture parts 14, 16 are coupled to each other may include one or more connecting bars or tubes such as tubes 32, 33 which are respectively arranged in the corners of the fixture parts 14, 16 next to the wall of the reflectors 18, 19. The tubes 32, 33 extend in longitudinal direction through the housing 12 of the fixture part 14 and into the housing 12 of the other fixture part 16.

As is further shown in FIG. 3, the lighting fixture 10 is further provided with a reflector 11 which is preferably made of glass and spans over the fixture parts 14, 15, 16 in longitudinal direction at a distance thereto, with the lateral ends of the reflector 11 extending beyond the lateral ends of housing 12 of the fixture parts 14, 16. In direction transverse to the longitudinal axis of the lighting fixture 10, the reflector 11 has a slightly concave curvature, preferably parabolic or arched. The reflector 11 is properly positioned by set collars 35, 36 supported by rods 39, 40 which carry the housing 12 and are connected to the mounts 17 for support of the lighting fixture 10 and the reflector 11 and attachment to the ceiling.

The lighting fixture 10 according to the invention generates no direct downward radiation of light. Rather, the fluorescent lamps 30, 31 emit light rays 37, 38 directly upwards to impinge upon the curved surface of the reflector 11. One fraction of incident light which passes through the reflector 11, as exemplified by broken arrow 37*a*. is reflected from the ceiling to provide a diffuse illumination. Another incident fraction of light, as exemplified by arrows 37, 38, is specularly reflected downwards by the shiny surface of the reflector 11 in direction of the desk 28, as exemplified by arrows 37*b*, 38*b*. The ratio between light rays reflected from the surface of the reflector 11 and light rays radiating toward the ceiling depends on the angle of incidence, i.e. a flatter angle of incidence will result in an increased surface reflection of light from the reflector 11. In addition, light emitted from the fluorescent lamps 30, 31 may also be reflected upwardly by the reflectors 18, 19, as indicated by arrows 20. These light rays may pass through or may be reflected by the reflector 11 in a same manner as previously described in connection with the fraction of light directly impinging upon the reflector 11.

Figure 2:
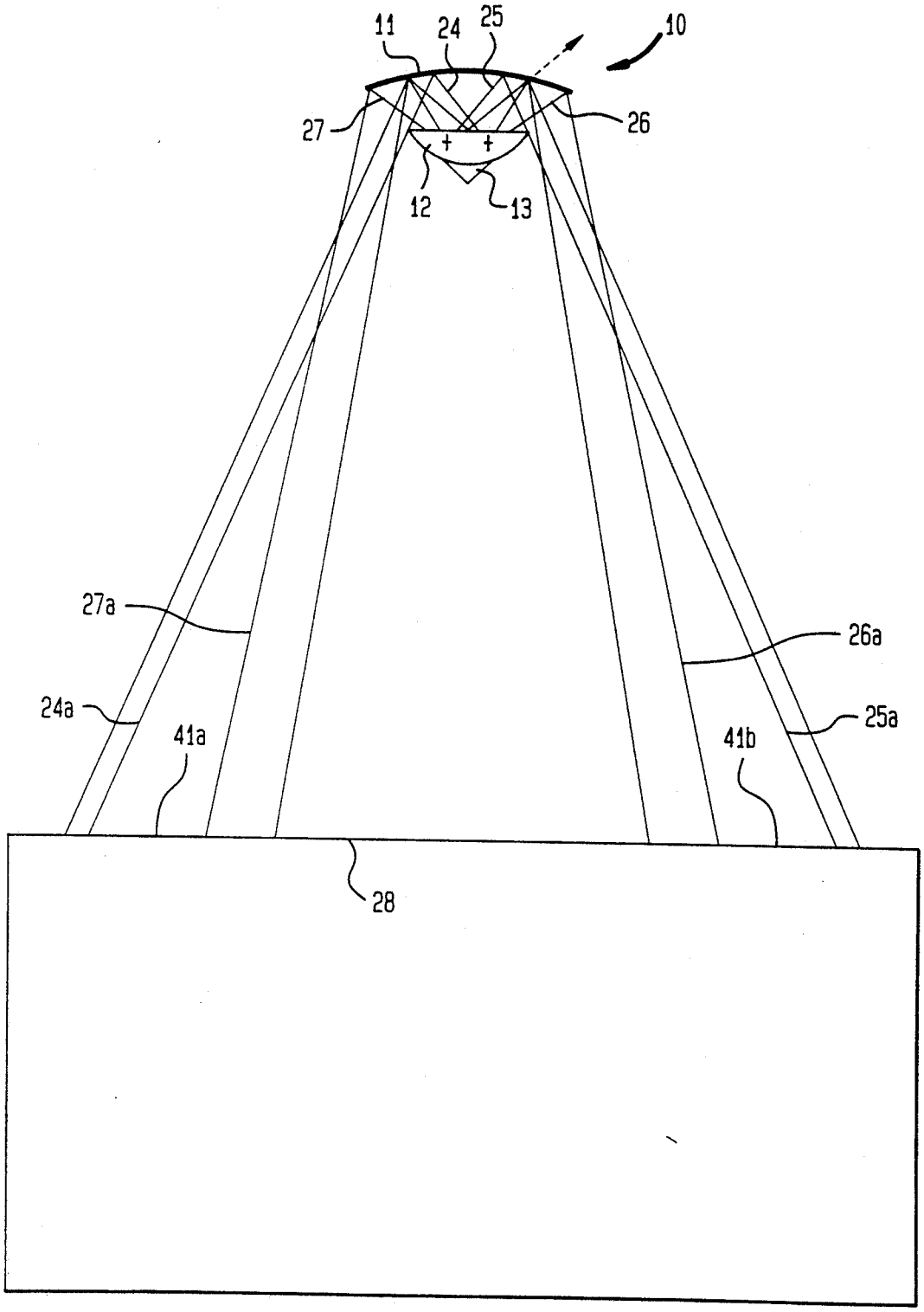
FIG. 2 is a simplified schematic illustration of the lighting fixture in direction of arrow II in FIG. 1.

The lighting fixture 10 is designed to combine a diffuse fraction of light radiating toward the ceiling with a fraction of light reflected by the reflector 11, with the latter fraction of light creating a better shadiness and better contrasts to achieve higher CRF values upon the working area 29. As shown in FIGS. 1 and 2, the working area 29 is illuminated by only indirect light which radiates primarily from a lateral direction of the outer fixture parts 14, 16. Light reflected by the reflector 11, such as e.g. light rays 24*a*, 27*a*, or 25*a*, 26*a*, create two zones of increased luminance upon the desk 28, with the zones being generated laterally of and extending parallel to the lighting fixture 10 in longitudinal direction thereof. Directly beneath the housing 12 of the lighting fixture 10 is a zone of reduced luminance. Light rays radiating from the outer fixture parts 14, 16 and reflected from the reflector 11 may also travel through the central part 15 to radiate downwards. This light, however, does not contain any vertical components.

Thus, with the lighting fixture according to the invention, it is possible to distinctly illuminate two working areas 41*a*, 41*b* for two persons sitting opposite to each other at adjoining desks at high contrast.

While the invention has been illustrated and described as embodied in a lighting fixture, it is not intended to be limited to the details shown since various modifications and structural changes may be made without departing in any way from the spirit of the present invention.

What is claimed as new and desired to be protected by Letters Patent is set forth in the appended claims

I claim:

1. A lighting fixture of the type being suspendable from a ceiling for illuminating a workplace; comprising:

a first fixture part;

a second fixture part spaced from said first fixture part in longitudinal direction, each fixture part having a top side;

lighting means accommodated in said fixture parts, with each fixture part radiating light generated by said lighting means exclusively toward the top side thereof; and reflector means arranged above and at a distance to said first and second fixture parts for reflecting a fraction of upwardly emitted light rays downwardly in direction of the workplace while allowing another fraction of upwardly emitted light rays to pass therethrough and to be reflected downwardly by the ceiling in direction of the workplace.

2. A lighting fixture as defined in claim 1, and further comprising a central fixture part in form of rods or pipes for mechanically connecting said spaced first and second fixture parts.

3. A lighting fixture as defined in claim 1 wherein each of said first and second fixture parts has a housing with open top and elongated, essentially cup-shaped configuration.

4. A lighting fixture as defined in claim 1 wherein said reflector means includes a reflector of glass.

5. A lighting fixture as defined in claim 2 wherein said reflector means spans over said first, second and central fixture parts.

6. A lighting fixture as defined in claim 3 wherein said housing has a width, said reflector means projecting with both lateral ends beyond the width of said housing.

7. A lighting fixture as defined in claim 1, with the lighting fixture defining a longitudinal axis, said reflector means having a slight concave curvature transversely to said longitudinal axis.

8. A lighting fixture as defined in claim 7 wherein said curvature of said reflector means is parabolic.

9. A lighting fixture as defined in claim 7 wherein said curvature of said reflector means is of circular arc shaped configuration.

10. A lighting fixture as defined in claim 3 wherein said housing includes a central triangularly-shaped protrusion to create space for accommodation additional elements.

* * * * *